United States Patent [19]

Staerzl

[11] Patent Number: 5,022,363

[45] Date of Patent: Jun. 11, 1991

[54] POSITIVE STARTING CIRCUIT

[75] Inventor: Richard E. Staerzl, Fond du Lac, Wis.

[73] Assignee: Brunswick Corporation, Skokie, Ill.

[21] Appl. No.: 569,565

[22] Filed: Aug. 20, 1990

Related U.S. Application Data

[62] Division of Ser. No. 288,729, Dec. 22, 1988, Pat. No. 4,951,620.

[51] Int. Cl.[5] ..... F02P 9/00

[52] U.S. Cl. ..... 123/179 BG

[58] Field of Search ..... 123/179 BG, 424, 625, 123/626

[56] References Cited

U.S. PATENT DOCUMENTS

| | | | |
|---|---|---|---|
| 3,623,464 | 11/1971 | Patis | 123/179 BG |
| 4,015,564 | 4/1977 | Fitzner | 123/602 |
| 4,364,344 | 12/1982 | Buetemeister | 123/179 BG |

FOREIGN PATENT DOCUMENTS

| | | | |
|---|---|---|---|
| 58-174166 | 10/1983 | Japan | 123/424 |
| 59-5880 | 1/1984 | Japan | 123/179 BG |

*Primary Examiner*—Andrew M. Dolinar

*Attorney, Agent, or Firm*—Andrus, Sceales, Starke & Sawall

[57] ABSTRACT

A positive starting system and circuit prevents false starting of a multicylinder two-cycle internal combustion engine (10). During initial cranking of the engine, starter kick-out is caused by ignition of a residual combustible charge in a cylinder, however the following cylinder does not have a combustible charge, and the engine ceasing running, thus requiring re-engagement of the starter to start the engine. The problem is solved by delaying ignition upon initial cranking until sufficient combustible charge is developed in the remaining cylinders. Upon initial cranking, ignition is disabled, and a timing delay interval is initiated. At the end of such interval, ignition is enabled.

5 Claims, 1 Drawing Sheet

POSITIVE STARTING CIRCUIT

This is a division of application Ser. No. 07/288,729, filed Dec. 22, 1988, now U.S. Pat. No. 4,951,620.

BACKGROUND AND SUMMARY

The present invention relates to starting circuitry for a two-cycle internal combustion engine.

The invention addresses problems of false starting, wherein the starter kicks-out upon ignition during initial cranking of the engine, but then the engine ceases running, thus requiring re-engagement of the starter to start the engine, and sometimes repeated restart attempts. It has been found that this false starting phenomenon is due to residual combustible charge in a cylinder which is ignited by the ignition circuit and causes kick-out disengagement of the starter from the flywheel, but wherein the following cylinder does not have a combustible charge, and hence the engine ceases running.

Upon recognizing the source of the problem as above noted, the present invention provides a simple solution by disabling ignition for a delay interval upon initial cranking of the engine such that ignition of any residual combustible charge in a cylinder is prevented during initial cranking. The delay interval is chosen to be long enough to permit sufficient combustible charge to be developed in the remaining cylinders before ignition is enabled. This interval is preferably about one-half second.

DETAILED DESCRIPTION

Figure 1:
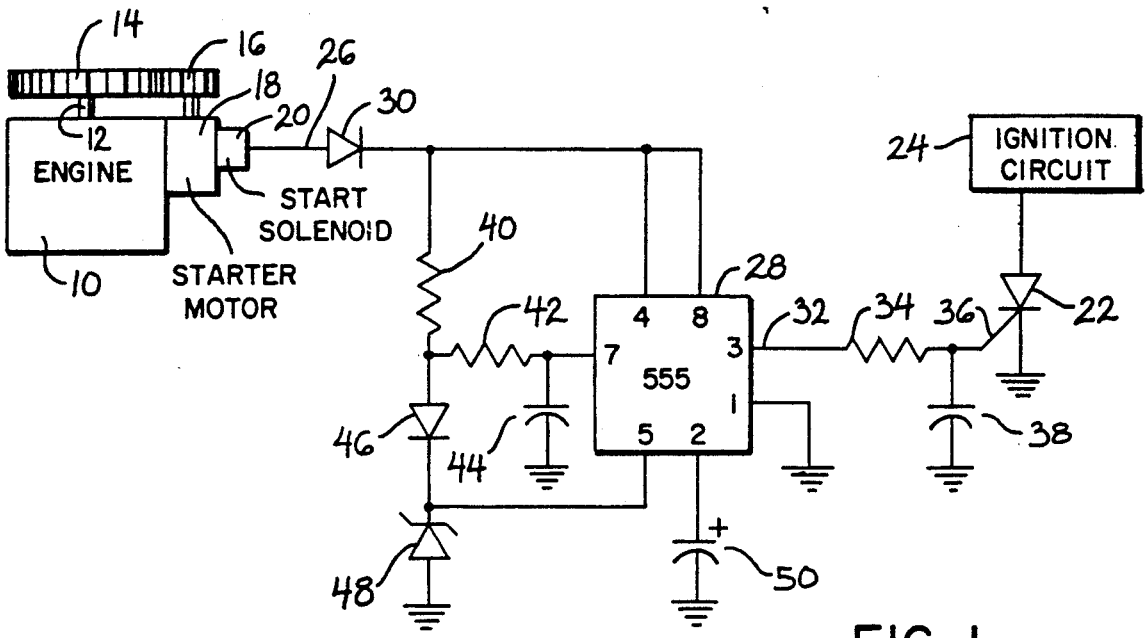
FIG. 1 is a circuit diagram illustrating a positive starting system in accordance with the invention.

FIG. 1 shows a multicylinder two-cycle internal combustion engine 10 having a crankshaft 12 and flywheel 14 cranked by starter gear 16 of starter motor 18 upon energization of start solenoid 20. Upon ignition of a combustible charge in an engine cylinder, the starter is kicked-out, i.e. starter gear 16 retracts out of engagement with flywheel 14, all as is well known.

It has been found that false starting during initial cranking of the engine is due to a residual combustible charge in a cylinder which is ignited by the ignition circuit and causes kick-out of the starter, and wherein the following cylinder does not have a combustible charge and the engine ceases running, thus requiring re-engagement of the starter to start the engine. In the present invention, this problem is solved by disabling the ignition at initial cranking of the engine to prevent ignition of any residual combustible charge in a cylinder. The delay interval is chosen to be long enough to permit sufficient combustible charge to be developed in the remaining cylinders before ignition is enabled. In the preferred embodiment, the delay interval is about one-half second, though other intervals may be used.

The positive starting circuit includes a kill switch 22 provided by an SCR connected between ground and the kill wire in the ignition circuit 24. Ignition kill switches so connected are known in the art, for example as shown in Fitzner U.S. Pat. No. 4,015,564, incorporated herein by reference. SCR 22 has a conductive state shorting the ignition circuit to ground to disable ignition, and a nonconductive state enabling ignition. An initiating circuit is provided by a connection circuit including conductor 26 connected to start solenoid 20 and responsive to initial cranking of the engine upon energization of the start solenoid and triggering switch 22 to its conductive state, disabling ignition. A delay circuit 28 responds to the trigger signal on conductor 26 of the initiating circuit to initiate a delay interval, and to trigger SCR 22 to its nonconductive state at the end of the delay interval, to thus enable ignition.

In operation, energization of start solenoid 20 provides a trigger signal on conductor 26 which is applied through protective diode 30 to timing circuit 28. Diode 30 protects the timing circuit against negative pulses upon de-energization of the start solenoid due to inductance thereof. Timing circuit 28 is a monostable multivibrator provided by a 555 IC timer chip, where manufacturer assigned pin number designations are shown to facilitate understanding. Multivibrator 28 has an output 32 connected through resistor 34 to control terminal or gate 36 of SCR 22 for controlling conduction thereof. Capacitor 38 is a noise filter. Resistor 34 is a current limiter. Input pins 4 and 8 of multivibrator 28 are connected through diode 30 to conductor 26 and respond to the triggering voltage therefrom to immediately drive output 32 high to thus turn on SCR 22 and disable ignition. The triggering signal from conductor 26 is also applied through resistors 40 and 42 to input pin 7 and to charging capacitor 44 connected to pin 7. The triggering signal is also applied through resistor 40 and diode 46 to input pin 5 having a voltage regulating zenner diode 48 connected thereto. Zenner diode 48 sets a reference voltage at input pin 5, and when capacitor 44 charges above such reference voltage, output pin 3 switches low to turn off SCR 22, thus enabling ignition. The charging time of capacitor 44 and the reference voltage set by zenner diode 48 determine the timing delay interval. Diode 46 provides reverse battery polarity protection. Capacitor 50 provides filtering.

Figure 2:
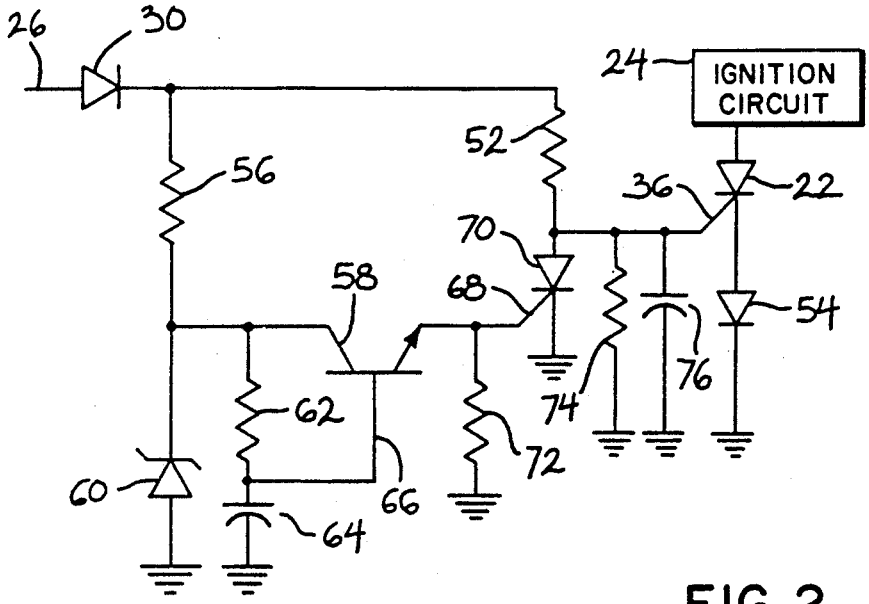
FIG. 2 shows an alternate embodiment.

FIG. 2 shows an alternate embodiment and uses like reference numerals from FIG. 1 where appropriate to facilitate clarity. Upon energization of the start solenoid, the triggering signal on conductor 26 through diode 30 and resistor 52 turns on SCR 22 to short the ignition circuit 24 to ground through diode 54, thus disabling ignition. The trigger signal is also applied through resistor 56 to provide a voltage at the collector of bipolar NPN transistor 58 which is regulated by the voltage regulator provided by zenner diode 60. This voltage is applied across resistor 62 to charge capacitor 64 and provide bias voltage to the base or control terminal 66 of transistor 58. When capacitor 64 charges above the base-emitter voltage of transistor 58, the latter turns on to provide a trigger signal to the gate or control terminal 68 of SCR 70 to turn the latter on and divert current away from gate 36 of SCR 22 and instead direct current from resistor 52 through SCR 70 to ground, whereby SCR 22 turns off, thus enabling ignition. The length of the timing delay interval is controlled by charging of capacitor 64. Resistor 72 references gate 68 of SCR 70 to ground so that the gate is not floating. Resistor 74 provides the same function for SCR 22. Capacitor 76 provides noise filtering. Diode 54 ensures a diode drop to ground from SCR 22 since SCR 70 is being used to clamp gate 36.

It is recognized that various equivalents, alternatives and modifications are possible within the scope of the appended claims.

What is claimed is:

1. A positive starting circuit for a multi-cylinder two-cycle internal combustion engine subject to starter kick-out during initial cranking of the engine due to a residual combustible charge in a cylinder which is ignited by an ignition circuit and causes kick-out of the starter, wherein the following cylinder does not have a combustible charge and the engine ceases running, thus requiring re-engagement of the starter to start the engine, said positive starting circuit comprising a kill switch coupled to said ignition circuit and having a first state disabling ignition and a second state enabling ignition, initiating means responsive to initial cranking of said engine and triggering said kill switch to said first state, delay means responsive to said initiating means to initiate a delay interval and triggering said kill switch to said second state at the end of said delay interval, such that ignition of residual combustible charge in a cylinder is prevented upon initial cranking, wherein said delay interval is chosen to be long enough to permit sufficient combustible charge to be developed in the remaining cylinders before ignition is enabled, wherein said kill switch comprises a semiconductor switch having a control terminal controlling the conduction state thereof between said first and second states, said delay means comprises a timing circuit connected between said semiconductor switch and said initiating means, wherein said timing circuit comprises a monostable multivibrator having an output connected to said control terminal of said semiconductor switch, said monostable multivibrator having a first input responsive to said initiating means to immediately drive said output to a first state which triggers said semiconductor switch to its said first state, said monostable multivibrator having a second input responsive to said initiating means to begin said delay interval, at the end of which said output of said monostable multivibrator switches to a second state triggering said semiconductor switch to its second state, wherein said monostable multivibrator has a third input responsive to said initiating means, said third input having a voltage regulator connected thereto, and wherein said second input of said monostable multivibrator has a charging capacitor connected thereto, and wherein said initiating means applied voltage to said second input of said monostable multivibrator to charge said capacitor an also applies voltage to said third input of said monostable multivibrator which is regulated by said voltage regulator to provide a reference voltage at said third input, such that the voltage at said second input of said monostable multivibrator rises as said capacitor charges and when the voltage at said second input rises above said reference voltage at said third input as regulated by said voltage regulator, said output of said monostable multivibrator switches to its said second state.

2. The invention according to claim 1 wherein said initiating means comprises conductor means connected to said starter.

3. The invention according to claim 2 wherein said initiating means is connected to said first, second and third inputs of said monostable multivibrator.

4. The invention according to claim 3 wherein said initiating means is connected through first and second resistors to said second input of said monostable multivibrator, said capacitor is connected to a node between said second resistor and said second input, said initiating means is connected through said first resistor to said third input of said monostable multivibrator, said voltage regulator comprises a zenner diode connected to a node between said first resistor and said third input of said monostable multivibrator.

5. The invention according to claim 12 further comprising a diode connected between said first resistor and said last mentioned node.

* * * * *